US007078995B2

(12) United States Patent
Hoffman et al.

(10) Patent No.: US 7,078,995 B2
(45) Date of Patent: Jul. 18, 2006

(54) FERRITE CORE

(76) Inventors: Thomas K. Hoffman, 410 Becker Ave. SW. Suite 2, Willmar, MN (US) 56201; Eric J. Arnold, 410 Becker Ave. SW. Suite 2, Willmar, MN (US) 56201

( * ) Notice: Subject to any disclaimer, the term of this patent is extended or adjusted under 35 U.S.C. 154(b) by 130 days.

(21) Appl. No.: 10/433,186

(22) PCT Filed: Jul. 20, 2001

(86) PCT No.: PCT/US01/22997

§ 371 (c)(1),
(2), (4) Date: Feb. 27, 2004

(87) PCT Pub. No.: WO02/45103

PCT Pub. Date: Jun. 6, 2002

(65) Prior Publication Data

US 2004/0150501 A1 Aug. 5, 2004

(51) Int. Cl.
*H01F 27/02* (2006.01)

(52) U.S. Cl. ..... 336/83

(58) Field of Classification Search ..... 336/65, 336/83, 178, 200, 212, 232–234
See application file for complete search history.

(56) References Cited

U.S. PATENT DOCUMENTS 3,371,301 A * 2/1968 Hisano ..... 336/83
5,489,884 A * 2/1996 Heringer et al. ..... 336/210
6,501,362 B1 * 12/2002 Hoffman et al. ..... 336/198
6,897,754 B1 * 5/2005 Jeong et al. ..... 336/83

* cited by examiner

*Primary Examiner*—Tuyen T Nguyen

(57) ABSTRACT

A core for minimizing the footprint of a core-based components while also minimizing the total harmonic distortion exhibited by the component. The core (40) includes a back wall portion (42), a central wall portion (44), and an outside wall portion (46). The back wall portion has a front (48) and a back (49), with a lower end (51), an upper end (52), and a pair of sides (54,55) extending between the lower and upper ends. The central leg portion protrudes from the front of the back wall portion, and the central leg portion is substantially centrally located on the front of the back wall portion. The outside wall portion protrudes from the front of the back wall portion. The central leg portion is elongated along a first axis extending between the upper and lower ends of the back wall portion. Optionally, the central leg portion is spaced from the lower edge of the back wall portion.

28 Claims, 8 Drawing Sheets

FERRITE CORE

BACKGROUND OF THE INVENTION

1. Field of the Invention

The present invention relates to ferrite cores and more particularly pertains to a new ferrite core for minimizing the circuit board footprint of a core-based component while also minimizing the total harmonic distortion exhibited by the component.

2. Description of the Prior Art

The use of ferrite cores is known in the prior art. The ferrite cores are situated in close proximity to coiled conductors to facilitate the flow of magnetic flux between the coils of a coiled conductor.

Some of the most popular prior art designs for ferrite coils are illustrated in FIGS. 1A, 1B, and 1C. These known core designs typically employ a cylindrical center leg and a horseshoe shaped outer leg. Variations include expanding the center leg along the increased gap, and placing additional breaks in the outer leg to enhance ventilation of the coiled conductor (FIG. 1B), and increasing the gap between the ends of the outer leg (FIG. 1C).

However, factors have combined to make these designs less than optimal for use in applications where circuit board space is at a premium, where the least amount of total harmonic distortion is desirable, and where interference between adjacent components should be minimized.

One area where this is especially true is in signal circuits of telecommunications applications, and one example is in the central telephone office installations of high speed telephone line service providers. The providers employ high-speed telephone line technologies such as Digital Subscriber Line (DSL), and variations of DSL such as ADSL, HDSL, SDSL, SHDSL, and MDSL, among others, for connecting customers through their conventional telephone lines to the internet and other networks. Because the provider must pay for the space occupied by the circuitry in the central telephone office, the trend has been toward miniaturization of the components mounted on the printed circuit boards of the circuits to minimize the occupied space. Miniaturization of the components not only permits more circuits, or telephone line connection ports, to be mounted on a circuit board, but also permits the circuit boards to be mounted in closer proximity to each other in a mounting rack. Thus, the trend has not only been to make the components smaller overall, but also shorter with respect to the height that the components protrude from the surface of the circuit board so that the boards can be mounted closer together in the mounting racks.

The miniaturization of the components, especially transformer and inductors and the ferrite cores employed in those transformers and inductors, has not been without its drawbacks. Smaller core sizes have required a greater number of conductor turns in the components. Increasing the number of turns in the components results in a number of detrimental effects, such as increased leakage inductance, increased distributive capacitance, increased capacitance between the primary and secondary windings of transformer components, and a general decrease in the bandwidth capacity of the components. Also, the total harmonic distortion exhibited by the newer core designs has been a concern, as well as the handling of DC bias.

In core configurations such as shown in FIGS. 1A, 1B, and 1C, the parts of the channel between the center leg and the outer leg where the width of the channel becomes larger, such as is present in these known cores below the center line (C) of the center leg, are more likely to magnetically saturate and are believed not to contribute significantly to the effective flux carrying capability of the core because the magnetic flux path length is longer than the path length in the parts of the core located above the center line (C).

The ferrite core according to the present invention substantially departs from the conventional concepts and designs of the prior art, and in so doing, provides an apparatus primarily developed for the purpose of minimizing the circuit board footprint of a core-based component while also minimizing the total harmonic distortion exhibited by the component.

SUMMARY OF THE INVENTION

In view of the foregoing disadvantages inherent in the known types of ferrite cores now present in the prior art, the present invention provides a new ferrite core construction wherein the same can be utilized for minimizing the circuit board footprint of a core-based component while also minimizing the total harmonic distortion exhibited by the component.

To attain this, the present invention generally comprises a back wall portion, a central wall portion, and an outside wall portion. The back wall portion has a front and a back, with a lower end, an upper end, and a pair of sides extending between the lower and upper ends. The central leg portion protrudes from the front of the back wall portion, and the central leg portion is substantially centrally located on the front of the back wall portion. The outside wall portion protrudes from the front of the back wall portion. In one aspect of the invention, the central leg portion is elongated along a first axis extending between the upper and lower ends of the back wall portion. In another aspect of the invention, the central leg portion is spaced from the lower edge of the back wall portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1A:
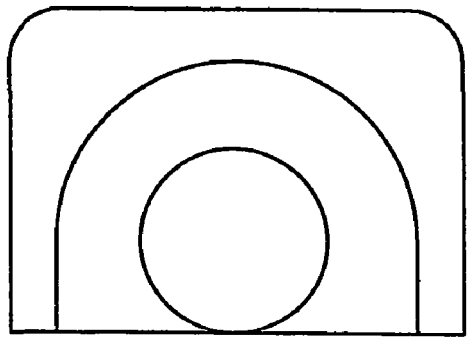
FIGS. 1A, 1B, and 1C are schematic front views of prior art magnetic cores.
Figure 1B:
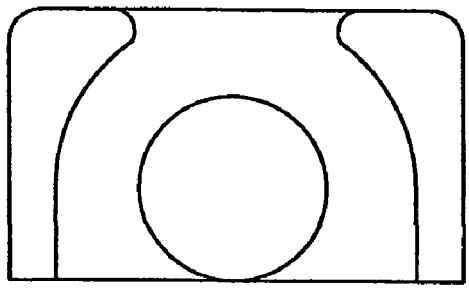
Figure 1C:
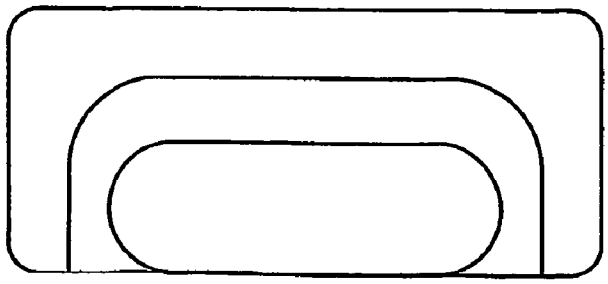
Figure 2:
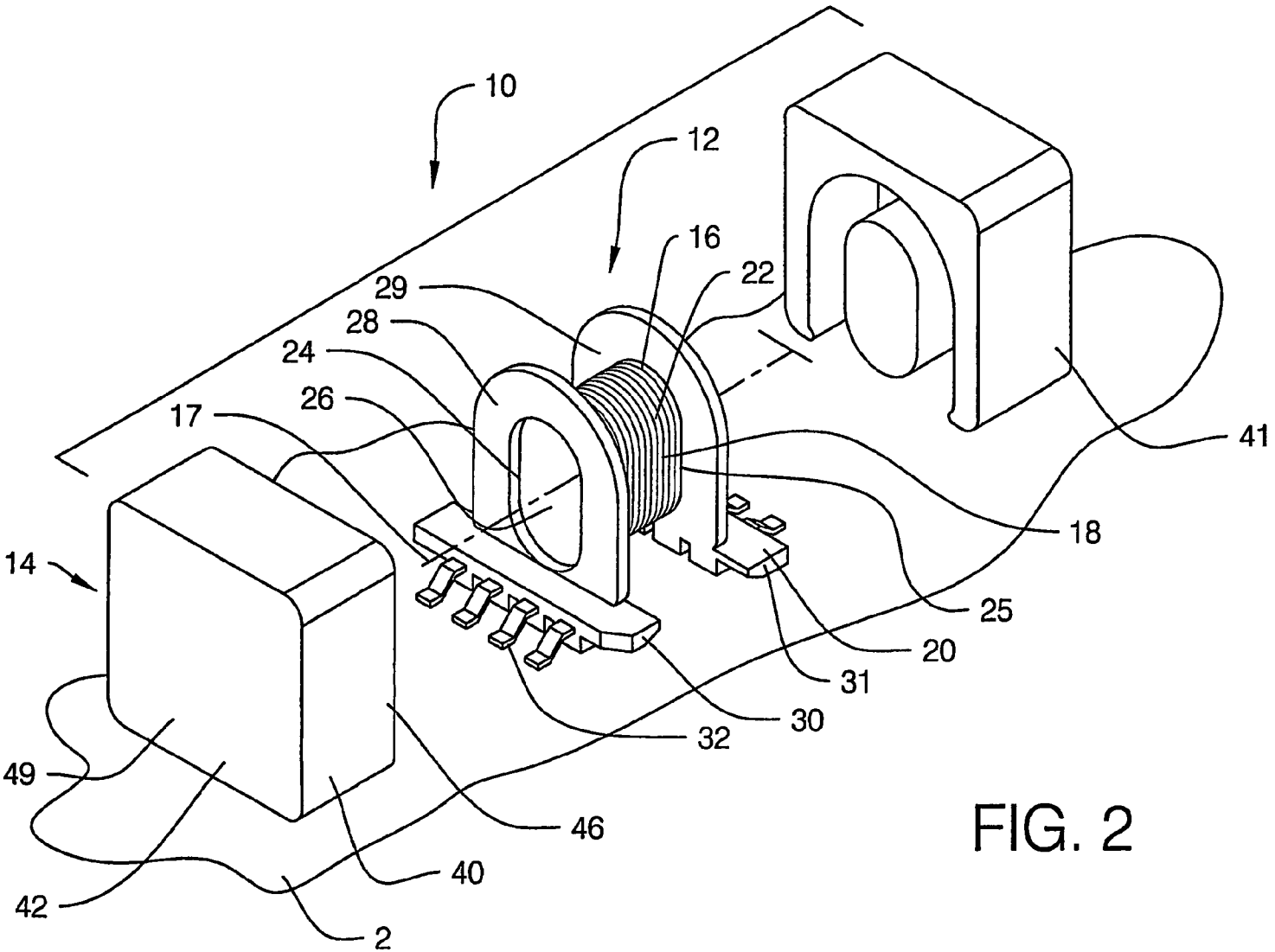
FIG. 2 is a schematic exploded perspective view of a transformer or inductor component employing a new core according to the present invention.
Figure 3:
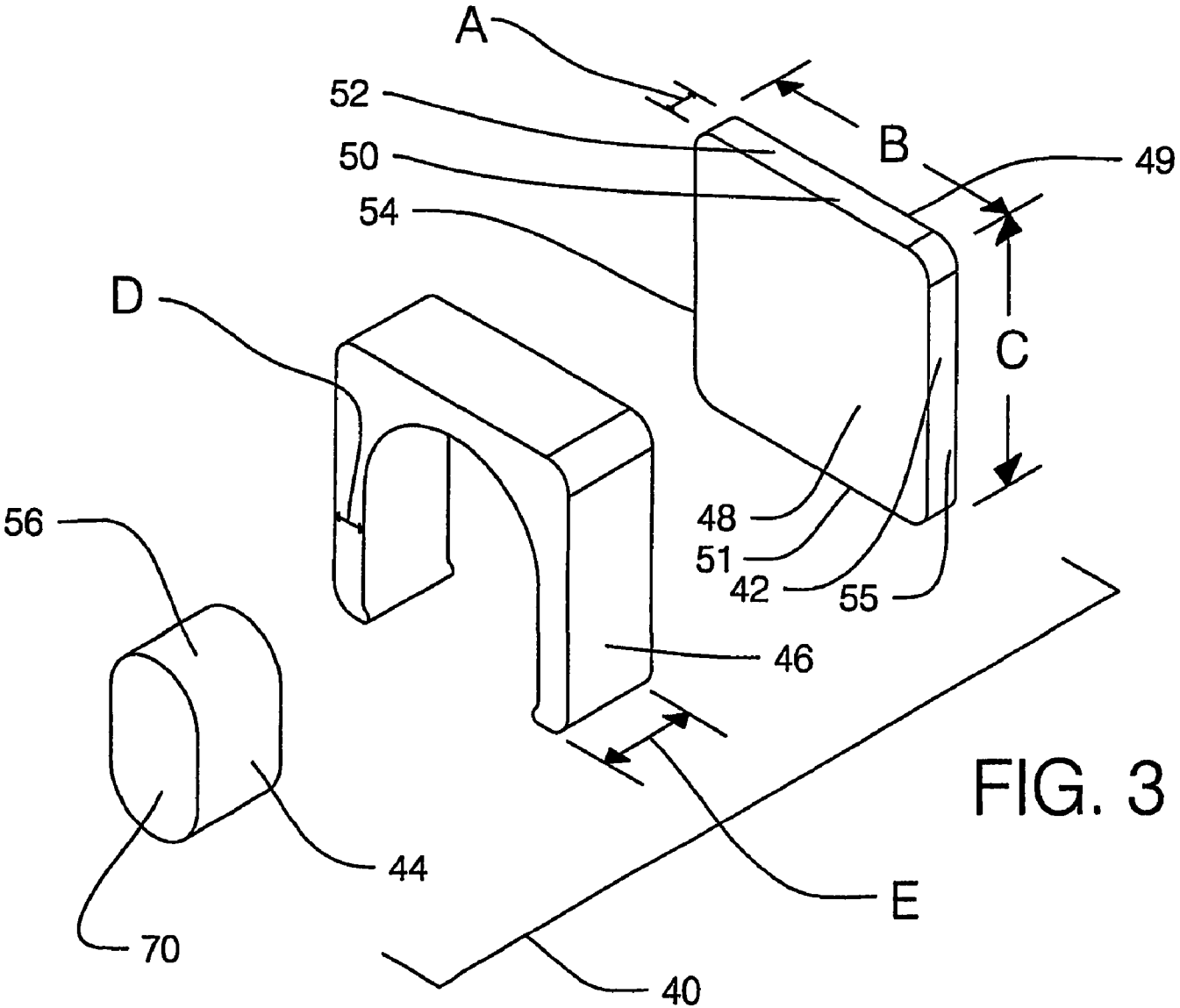
FIG. 3 is a schematic exploded perspective view of the portions of the core of the present invention.
Figure 4:
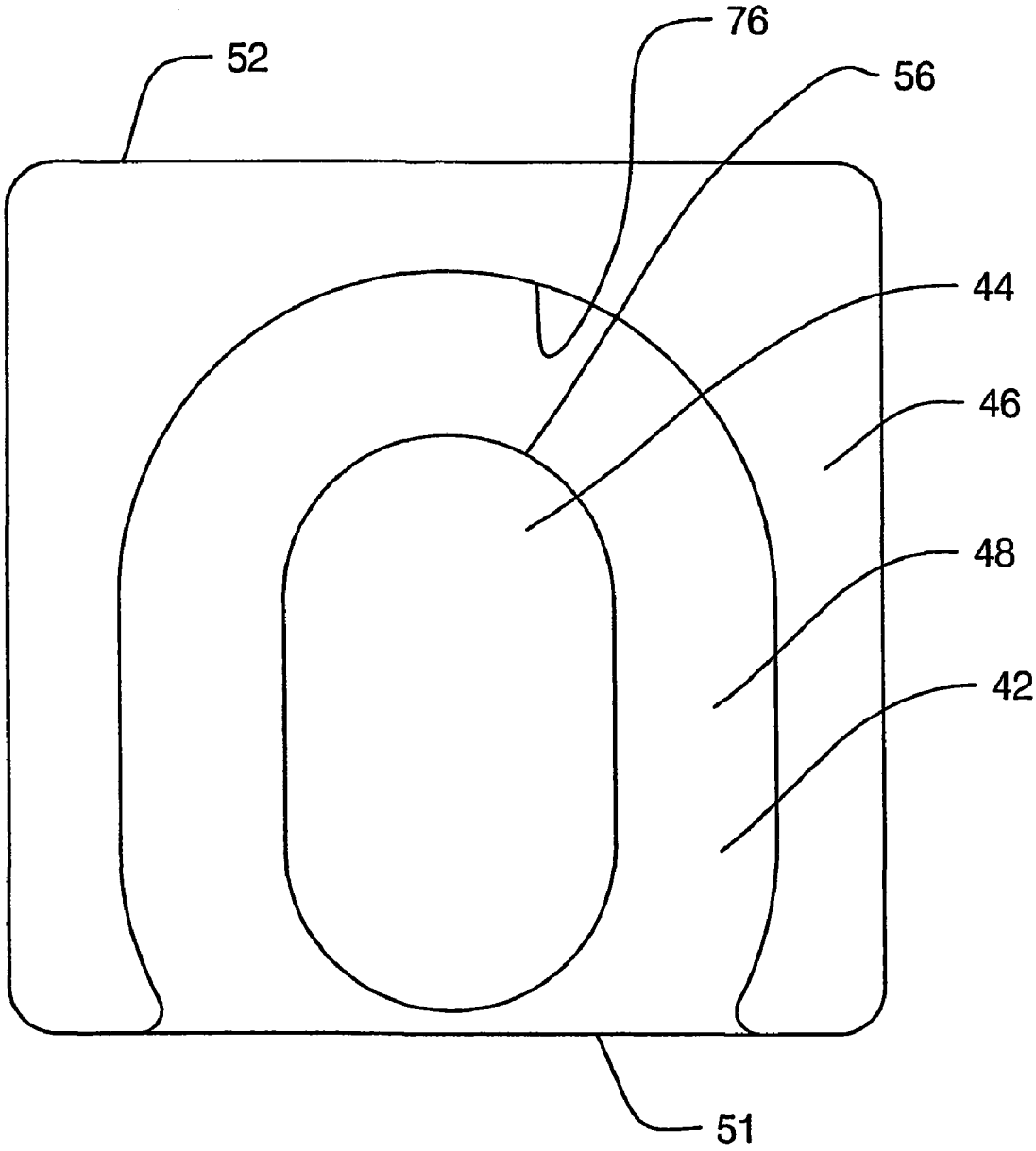
FIG. 4 is a schematic front view of the present invention.

With reference now to the drawings, and in particular to FIGS. 2 through 8 thereof, a new ferrite core embodying the principles and concepts of the present invention is illustrated.

The ferrite core of the invention is highly suitable for use in a component 10 employing a coiled conductor 16 such as, for example, a transformer or an inductor. The core of the invention is especially suitable in applications where it is desirable to have low harmonic distortion created by the component, such as where the component is primarily employed for signal handling, although the core may also be employed in components employed in power supply applications.

The ferrite core of the invention is suitably employed in a component 10 that includes a coil assembly 12 and a core assembly 14. The coil assembly 12 may comprise a bobbin 18, a coiled conductor 16 mounted on the bobbin, and a base structure 20 for mounting the bobbin on a circuit board. Components of this type are typically mounted on a printed circuit board 2 for connection to other components, and the surface of the circuit board defines a mounting plane. The mounting plane of the circuit board may be oriented substantially vertically or substantially horizontally. Further, the component may be mounted on the circuit board in different orientations, such as a first orientation (sometimes known as a horizontal mount) in which a central axis 17 of the coiled conductor extends substantially parallel to the mounting plane, and a second orientation (sometimes known as a vertical mount) in which the central axis of the coiled conductor extends substantially perpendicular to the mounting plane. For the purposes of description, the component will be described as constructed for mounting in the first orientation, with the understanding that the component may be constructed for mounting in the second orientation without significant variation in the configuration of the core assembly of the component.

The bobbin 18 of an exemplary embodiment of the component described herein includes a central tubular portion 22. The central tubular portion has opposite ends 24, 25, and a lumen 26 extending between the ends. The lumen 26 is open at the ends. Preferably, the lumen has an oblong cross section taken perpendicular to an axis of the lumen that extends between the openings at the ends. The cross-sectional shape of the lumen is preferably adapted to closely follow the shape of the outer surface of the central leg portion of the core for following the most compact construction. Preferably, but not critically, the bobbin includes a pair of end flanges 28, 29, with each end flange being mounted on one of the respective ends 24, 25 of the central tubular portion 22 to form a spool-like structure. Each of the end flanges has a perimeter, and preferably the shape of the perimeter of the flange is adapted to fit in the channel defined between the central leg portion and outside leg portion of the core. In the exemplary embodiment, the perimeters of the end flanges have an oblong shape.

The coiled conductor 16 is wound about the central tubular portion 22 of the bobbin 18 and may comprise, for example, a metallic wire. The base structure 20 of the bobbin may include a base foot 30, 31 mounted on each one of the end flanges of the bobbin, with each base foot being adapted for resting against a surface of a printed circuit board. Each base foot may have at least one conductive lead 32 extending outwardly from the base foot, with the conductive lead being connected to the coiled conductor wound on the bobbin. The particular structure of the base structure may vary, especially if the component is to be mounted in the second orientation.

The ferrite core 40 of the invention is preferably part of a core assembly 14 that mounts on the coil assembly 12 to form the component. The core assembly 14 is preferably adapted to substantially enclose the bobbin and coiled conductor of the coil assembly 12 to reduce interference with other components located in close proximity to the component on a circuit board. Holes or openings in the core assembly tend to permit the leakage of magnetic flux from the component, which can induce interference in adjacent components.

The core assembly 14 comprises a pair of cores 40, 41, with each of the cores being adapted for positioning in an opposed, mirrored relationship about the bobbin 18 and the coiled conductor 16 of the coil assembly. As the cores most preferably are substantially identical in form, a single core 40 will be described with the understanding that the description of core 40 also applies to the core 41. The core 40 includes a back wall portion 42, a central leg portion 44 protruding from the front 48 of the back wall portion, and an outside wall portion 46 protruding from the front 48 of the back wall portion. Preferably, the portions 42, 44, and 46 of the core 40 are integrally formed as a single piece of ferrite material.

The back wall portion 42 has a front 48 and a back 49, and an outer perimeter 50 extending between the front and back. The back wall portion 42 has a thickness dimension (A) that may be measured between the front 48 and back 49. Preferably, the thickness of the back wall portion is substantially uniform throughout the back wall portion. In the exemplary embodiment of the invention, the back wall portion has a substantially rectangular outer perimeter 50 which is defined by a lower end 51, an upper end 52, and a pair of sides 54, 55 extending between the lower and upper ends. A width (B) of the back wall portion is defined between the sides 54, 55 and a length (C) of the back wall portion is defined between the lower 51 and upper 52 ends. The back 49 of the back wall portion may be substantially planar. In the first mounting orientation of the component, the plane of the back 49 of the back wall portion 42 is oriented substantially perpendicular to the mounting plane, and in the second mounting orientation, the plane of the back is oriented substantially parallel to the mounting plane.

The central leg portion 44 of the core 40 is substantially centrally located on the front 48 of the back wall portion. The central leg portion has an outer surface 56 that extends along a perimeter of the central leg portion, and the outer surface extends substantially perpendicular to the front of the back wall portion.

Significantly, the central leg portion 44 of the invention is elongated in a direction substantially perpendicular to the mounting plane (when the core is in the first orientation) for the purposes of maximizing the overall magnetic flux path (and flux carrying capacity) of the core while minimizing the area of the footprint on the circuit board that is occupied by a component employing the core of the invention.

The central leg portion 44 is elongated along a first axis 58 that extends substantially perpendicular to the lower end 51 of the back wall portion, and substantially parallel to the plane of the back 49 of the back wall portion. The first axis 58 is oriented such that it is positioned substantially perpendicular to the mounting plane of a circuit board when the component is mounted on the circuit board in the first orientation. The elongated central leg portion has an intermediate section 60 and a pair of end sections 62, 63, with the intermediate section being located between the end sections. The central leg portion is preferably symmetrical about the first axis 58. The intermediate section 60 has a length dimension that extends substantially parallel to the first axis 58 and a width dimension that extends substantially perpendicular to the first axis. Preferably, the width of the intermediate section 60 is substantially uniform along the length of the intermediate section. Significantly, the length of the intermediate section is equal to an elongation of the central leg portion as compared to a cylindrical central leg portion. This elongation may range from an intermediate portion having a length as small as approximately 0.1 mm. Between the end sections 62, 63 of the central leg portion, the intermediate section 60 may have a substantially rectangular shape in a plane oriented substantially parallel to the front 48 of the back wall portion. The outer surface 56 of the central leg portion 44 may have a pair of substantially planar extents 64, 65 on the intermediate section 60 of the leg portion, with the substantially planar extents preferably being oriented substantially parallel to each other.

Each of the end sections 62, 63 may have a semi-cylindrical shape, with a center of curvature 66, 67 and a radius extending between the center of curvature and the outer surface 56 of the respective end section of the central leg portion. The outer surface 56 of the central leg portion preferably has a pair of curved extents 68, 69 located on the end sections. It should be realized that, while a curved outer surface on the end sections is highly preferable, the outer surface bordering the end sections may be comprised of a plurality of planar surfaces oriented perpendicular to a radius extending from the center of curvature. The central leg portion has a forward face 70, and preferably the forward face is substantially planar and lies in a plane substantially parallel to the front 48 of the back wall portion.

A second axis 72 and a third axis 74 extend substantially perpendicular to the first axis 58. The second axis extends along a border between a primary one 62 of the end sections of the central leg portion and the intermediate portion 60 of the central leg portion, and passes through the center of curvature 66. The third axis extends along a border between a secondary one 63 of the end sections of the central leg portion and the intermediate portion, and passes through the center of curvature 67.

The outside wall portion 46 protrudes from the front 48 of the back wall portion. Preferably, the outside wall portion 46 has a generally horseshoe arch shaped configuration about the central leg portion. The outside wall portion 46 has an inner surface 76 facing the central leg portion. The inner surface 76 has an arcuate extent 78 positioned in an opposed relationship to the curved extent 68 of the outer surface of the primary end section 62 of the central leg portion. The outside wall portion also has an outside surface 80, and a width (D) of the outside wall portion is measured between the inner surface 76 of the outside wall portion and the outside surface 80 of the outside wall portion. The width may be measured along a line extending perpendicular to a tangent to the inner surface of the outside wall portion. For purposes of measuring the flux path of uniform cross-sectional area of the core, the smallest uniform width of the outside wall portion should be used in calculations.

The outside wall portion 46 has a pair of ends 82, 83 that are located adjacent to the lower end 51 of the back wall portion 42. A separation gap 84 is formed between the ends 82, 83 of the outside wall portion for passing through the conductor and the base structure of the coil assembly. The separation gap 84 is substantially bisected by the first axis. An end segment 86, 87 of the outside wall portion is located adjacent to each of the ends 82, 83. Each of the end segments of the outside wall portion extends between the third axis and the end of the outside leg portion. Most preferably, the end segment 86, 87 extends along an arc such that a substantially uniform spacing between the outer surface 56 of the central leg portion and the inner surface 76 of the outside wall portion is maintained substantially to the end 82, 83 of the outside wall portion.

Figure 5:
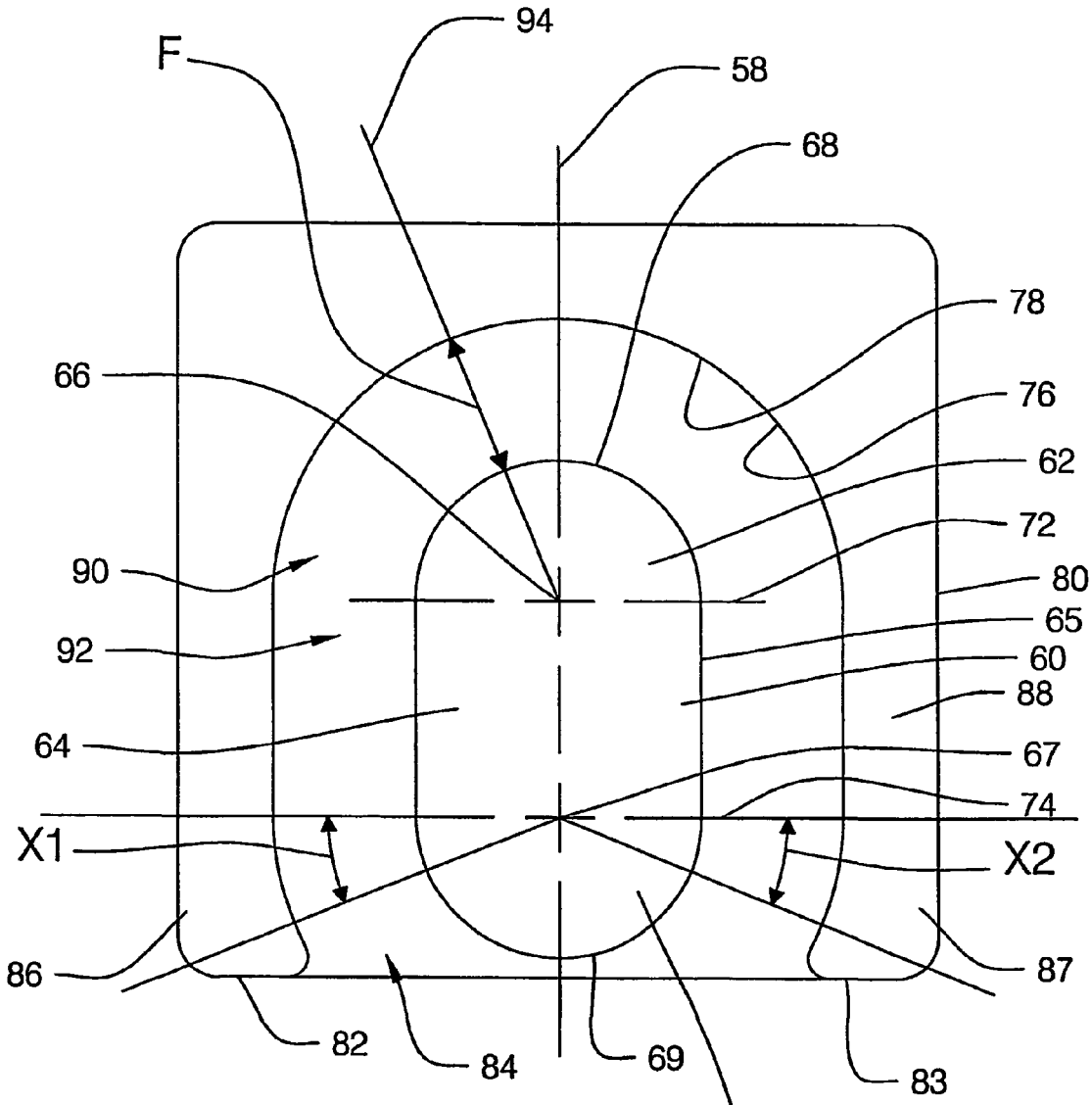
FIG. 5 is a schematic front view of the present invention shown in FIG. 4 particularly illustrating the axes associated with the core.
Figure 6:
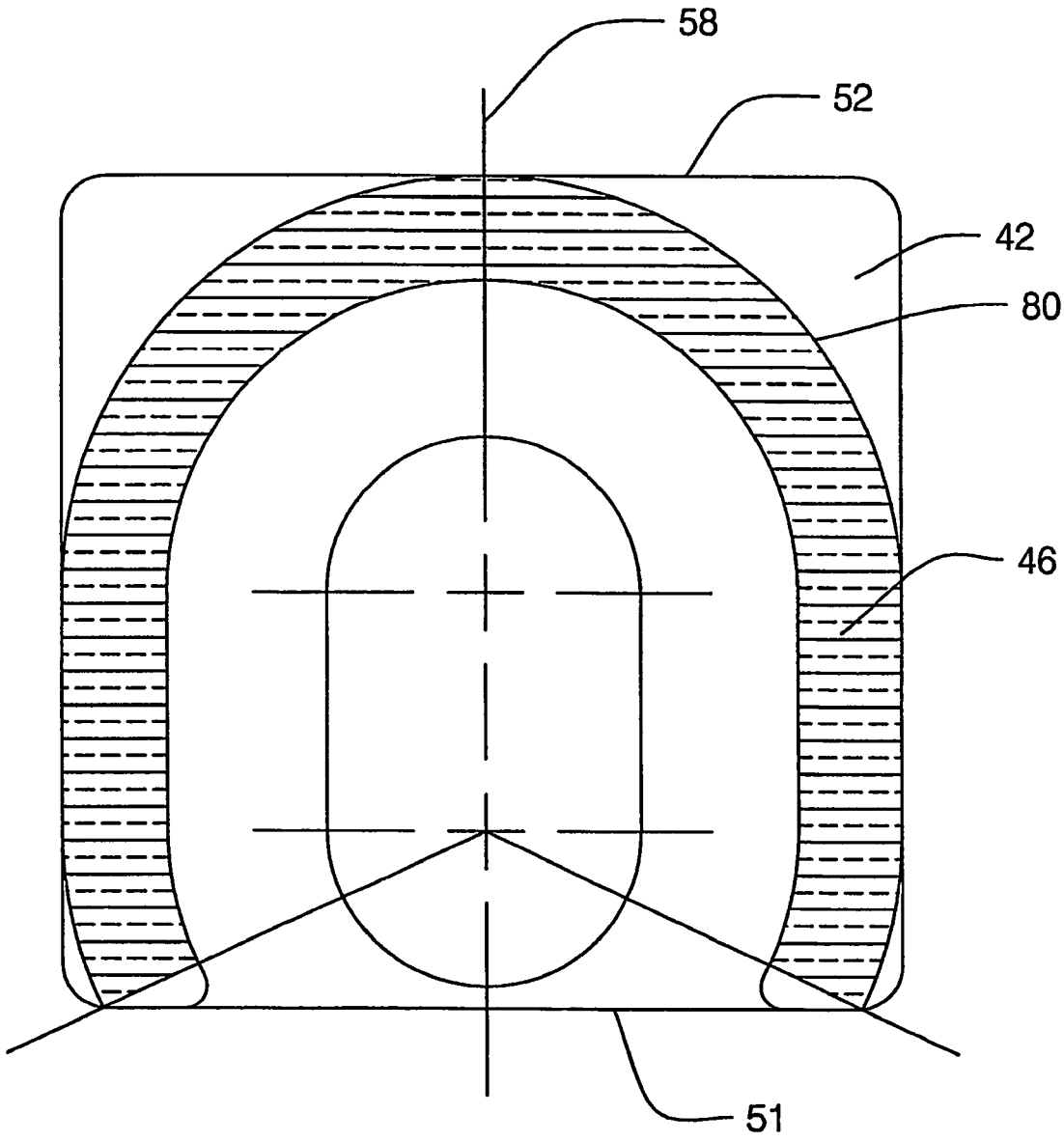
FIG. 6 is a schematic front view of an optional configuration of the core of the present invention particularly illustrating an outside leg having a substantially uniform width along the end sections of the outside wall portion.

A closure angle is centered on the center of curvature 67 of the secondary end section 63 of the central leg portion, and is measured between the third axis and the extent of the end segment of the outside wall portion that meets the condition that a uniform width is maintained between the end segment and the central leg portion, and the condition that a uniform cross sectional area of the end segment is maintained (see FIG. 5). Most preferably, the closure angle does not includes portions of the end segments which are either spaced from the central leg portion a distance that is greater than the uniform spacing between the central leg portion and the outside wall portion, or the cross sectional area of the outside wall portion is reduced from the area of the outside wall portion at the intersection with the third axis. The closure angle X1 of a first one 86 of the end segments may be substantially equal to the closure angle X2 of a second one 87 of the end segments to create a symmetry between the end segments. The closure angle X1, X2 may range from zero degrees up to approximately ninety degrees, with angles ranging from approximately thirty degrees to even approaching ninety degrees being highly desirable for maximizing the flux path of uniform cross-sectional area of the core in which saturation is not likely to occur. One factor limiting the size of the angle X1, X2 may be provided the clearance necessary for passage of the conductor and the base structure between the ends, and may limit the angles from fully reaching ninety degrees and a full closure of the separation gap 84.

The outside wall portion 46 also has a forward face 88 that may be substantially planar. The forward face 88 may lie in a plane that is substantially parallel to the front 48 of the back wall portion 42. The forward face 88 may be in the same plane as the forward face 70 of the central leg portion. In order to increase the DC bias handling capability exhibited by the component, it may be desirable that at least one of the cores 40, 41 of the core assembly have a central leg portion 44 that extends short of the plane of the forward face 88 of the outside wall portion so that a relatively small separation is formed between the central leg portions of the opposed cores of a core assembly. The outside wall portion has a thickness dimension (E) that may be measured between the forward face 80 of the outside wall portion and the front 48 of the back wall portion. Preferably, the thickness of the outside wall portion is substantially uniform between the ends 82, 83.

A gap 90 is formed between the outer surface 56 of the central leg portion and the inner surface 76 of the outside wall portion, and the gap forms a channel 92 extending about the central leg portion between the central leg portion and outside wall portion. A plurality of flux path axes extend outwardly from the central leg portion, with each flux path axis 94 extending substantially perpendicular to a line oriented tangent to a location on the outer surface 56 of the central leg portion. Each of the flux path axes 94 crosses the gap 90 and extends into the outside wall portion 46. The gap 90 has a width dimension (F) that may be measured between the outer surface 56 of the central leg portion and the inner surface 76 of the outside wall portion along each flux path axis. The gap 90 has a depth that may be measured between the front 48 of the back wall portion and a plane defined by the forward face 88 of the outside wall portion, and is typically equal to the thickness dimension (E) of the outside wall portion.

For the purposes of reducing the total harmonic distortion imposed by the component on the voltage of the signal passing through the component, the portion of the channel in which the width (F) of the gap is substantially uniform should be maximized in the core to maximize the part of the outside wall portion (and back wall portion) through which the magnetic flux path may extend with less likelihood of saturation.

Even more significantly, it has been found that maximizing the parts of the core that provides a uniform magnetic path length and a uniform cross sectional area reduces the total harmonic distortion created by the core. The part of the core meeting both of these conditions is hereinafter referred to as meeting the uniform magnetic path length of a uniform cross sectional area ("UMPLUCSA") condition. It is believed that the parts of the core that do not meet the UMPLUCSA condition do not contribute significantly to the distortion characteristics of the core, and should not be considered when calculating the effective parameters of the core. The International Electrotechnical Commission (IEC) has published International Standard 205 for establishing the calculation of the effective parameters of a core, including an effective cross-sectional area (Ae) and an effective magnetic path length (le).

For the purposes of determining the uniform magnetic path length of uniform cross sectional area of the core of the invention, the area of the central leg portion may be calculated by using the following formula:

$$\text{Area of central leg portion}=W_{IS}*L_{IS}+\pi*R_{ES}^2$$

$W_{IS}$—Width of intermediate section of central leg portion $L_{IS}$—Length of intermediate section of central leg portion $R_{ES}$—Radius of outer surface of end section of central leg portion For the purposes of determining the uniform magnetic path length of uniform cross sectional area for the core of the invention, the area of the outside wall portion may be calculated by using the following formula:

$$\text{Area of outside wall portion}=[(180+X1+X2)/360]*\pi*[(W_{OWP}+W_G+R_{ES})^2-(R_{ES}+W_G)^2]+2\times W_{OWP}\times L_{OWP}$$

X1—First closure angle

X2—Second closure angle $W_{OWP}$—Width of outside wall portion $W_G$—Width of gap $R_{ES}$—Radius of outer surface of end section of central leg portion $L_{OWP}$—Length of extension of outside wall portion (equals $L_{IS}$)

For the purposes of determining the uniform magnetic path length of uniform cross sectional area for the core of the invention, the area of the back wall portion may be calculated by using the following formula:

$$\text{Area of back wall portion}=T_{BWP}*[W_{IS}*\pi*[(180+X1+X2)/360]+2*L_{IS}]$$

$T_{BWP}$—Thickness of back wall portion $W_{IS}$—Width of intermediate section of central leg portion X1—First closure angle X2—Second closure angle $L_{IS}$—Length of intermediate section of central leg portion For optimization of the magnetic flux path of the core, the calculated areas of the back wall portion and the outside wall portion should at least equal, or even exceed, the calculated area of the central leg portion so that the flux path through the central leg portion is not constricted through the outside wall portion or the back wall portion. Significantly, the expansion of the central leg portion by the elongation of the central leg portion of the core increases the area available for magnetic flux flow through the core-, but the increase in area of the central leg portion must be equaled or exceeded by the areas of the outside wall and back wall portions to meet the uniform cross sectional area condition to thereby take full advantage of the increased flux flow capability. Additionally, to meet the UMPLUCSA condition, the areas of the back wall portion and the outside wall portion considered in the area calculations should be located at a uniform distance from the central leg portion so that relatively nearer areas of the flux path through the outside and back wall portions are not saturated by the magnetic flux while relatively farther areas of the flux path through the outside and back wall portions carry less of the magnetic flux, thus tending to create a non-uniform flux flow through the uniform area.

The extension of the central leg portion also permits an increase of the ratio of the area of the central leg portion to the area (or footprint) occupied by the core on the circuit board. For the purposes of this description, the area of the footprint of the component may be approximated by multiplying the width (B) of the back wall portion by twice the sum of the thicknesses of the back wall portion (A) and the outer wall portion (E); the area of the central leg portion is as determined by the calculation set forth above. Through the use of the elongated central leg portion of the invention, the ratio of the area of the central leg portion to the area of the footprint of the component is greater than approximately 0.14. Stated another way, the area of the central leg portion is at least approximately 14% of the area of the footprint of the component.

A similar relationship involves a ratio between the area of the central leg portion to the product of the area of the footprint occupied by the core on the circuit board and the effective length (le as calculated by IEC 205), which is increased by the employment of the elongated central leg portion of the invention. A core employing the elongated central leg portion may exhibit such a ratio of at least approximately 0.8.

The extension of the central leg portion also permits an increase of the ratio of the perimeter of the central leg portion to the area of the footprint occupied by the core on the circuit board. For example, in the case where semi-cylindrical end sections are employed on the central leg portion, the perimeter of the central leg portion may be approximated as follows:

$$\text{Perimeter}=\pi*W_{IS}+2*L_{IS}$$

$W_{IS}$—Width of intermediate section of central leg portion $L_{IS}$—Length of intermediate section of central leg portion Through the use of the elongated central leg portion of the invention, the ratio of the perimeter of the central leg portion to the area of the footprint of the component is greater than approximately 0.16/mm.

The extension of the central leg portion also permits an increase of the ratio of the perimeter of the central leg portion that meets the UMPLUCSA condition to the area of the footprint occupied by the core on the circuit board. For example, in the case where semi-cylindrical end sections are employed on the central leg portion, the part of the perimeter of the central leg portion that meets the UMPLUCSA condition may be approximated as follows:

$$Perimeter_{UMPLUCSA}=W_{IS}*\pi*[(180+X1+X2)/360]+2*L_{IS}$$

X1—First closure angle

X2—Second closure angle $W_{IS}$—Width of intermediate section of central leg portion $L_{IS}$—Length of intermediate section of central leg portion Through the use of the invention, the ratio of the perimeter of the central leg portion that meets the UMPLUCSA condition to the area of the footprint occupied by the core on the circuit board is greater than approximately 0.82/mm. Further, the ratio of the perimeter of the central leg portion that meets the UMPLUCSA condition to the perimeter of the central leg portion is enhanced by the elongated central leg portion, and ratios greater than approximately 0.5 are contemplated by the invention, and preferably includes ratios above approximately 0.52.

Figure 7:
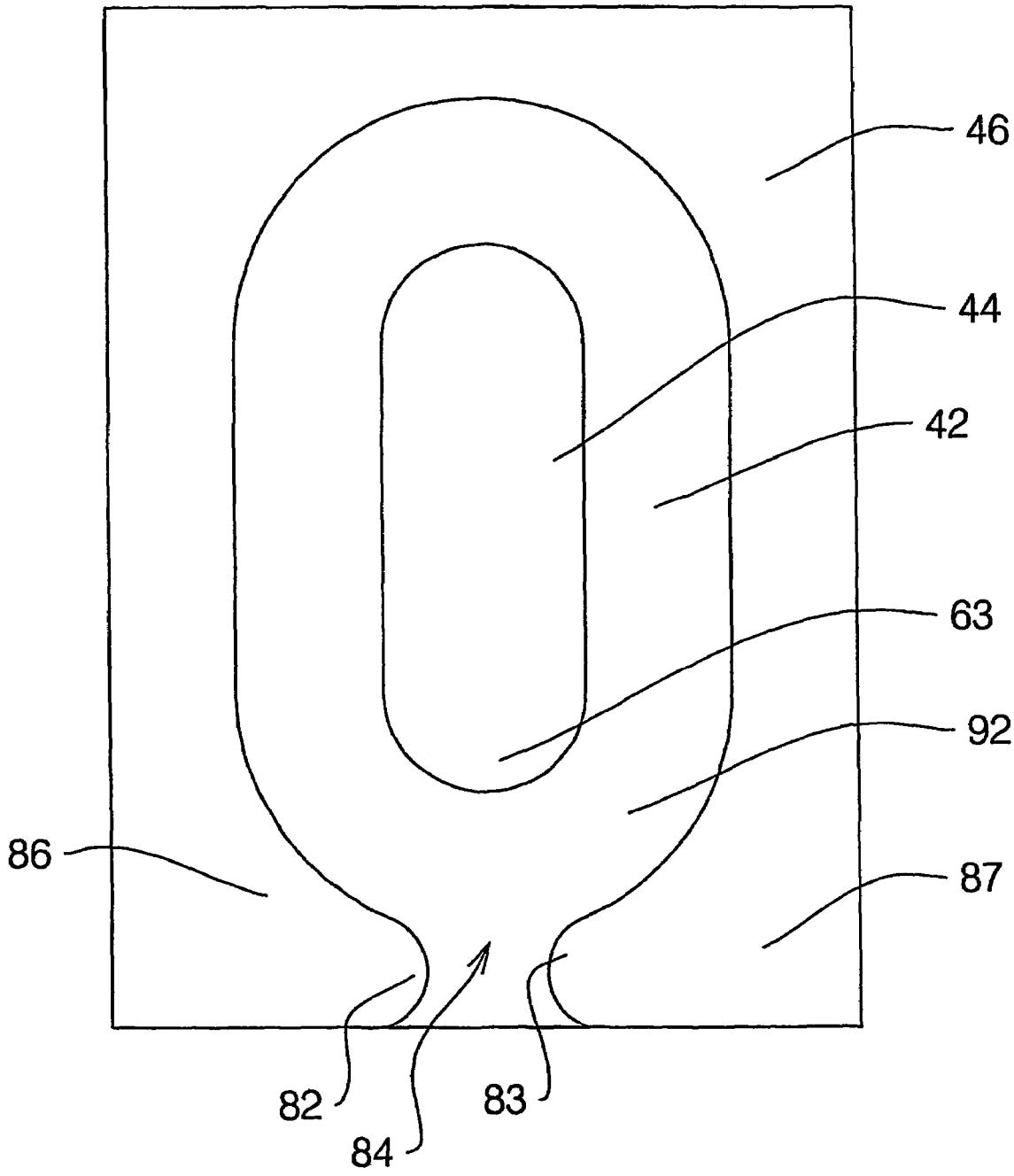
FIG. 7 is a schematic front view of another optional configuration of the core of the present invention.
Figure 8:
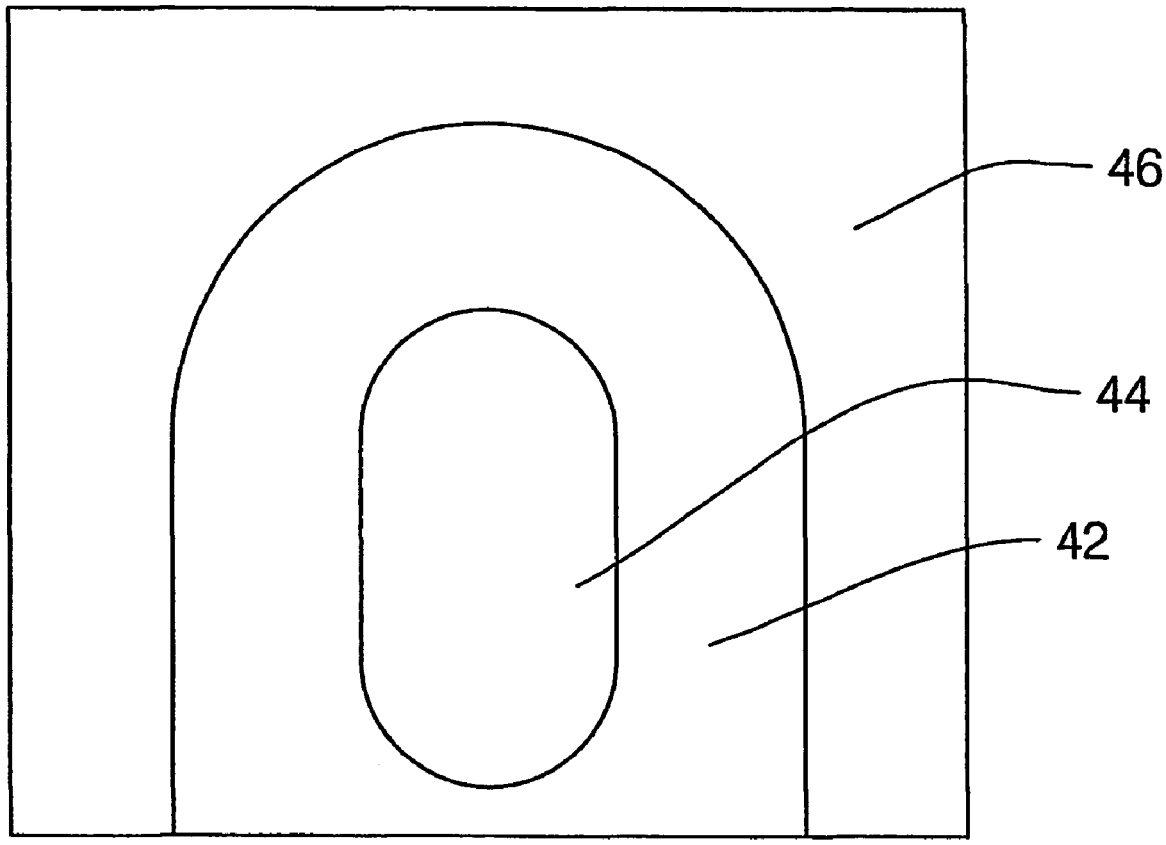
FIG. 8 is a schematic front view of another optional configuration of the core of the present invention.

A significant optional feature of the invention involves spacing the central leg portion from the lower end of the back wall portion of the core, which permits extending the end segments of the outside wall portion, and also permits extending the channel to positions between the central leg portion and the lower end of the back wall portion (see FIG. 7). A significant part of the extended portion of the channel (located between the third axis and bottom edge of the back wall portion) may have a uniform width, and the extension of the uniform width of the end segment of the outside leg portion increases the closure angle and the area of the outside wall portion. The inner surface of the outside wall portion along the extended portion of the channel extends along substantially the entirety of the closure angle. The extension of the outside wall portion about the central leg portion facilitates maximization of the enclosure of the coil assembly by the core assembly, and thus enhances the containment of flux leakage from the coil assembly by the core assembly.

It has also been found that the area of the outside wall portion that exceeds the area of the central leg portion is essentially unneeded for the purpose of magnetic flux flow through the core, and may be eliminated from the core. Uniform distribution of the area of the outside wall portion (when employing the elongated central leg portion) results in the outside wall portion being a uniformly wide band about the central leg portion (see FIG. 6). Generally, this results in the rounding of the corners of the outside wall portion, especially in the corners toward the upper end of the back wall portion. Optionally, the back wall portion could be configured with a profile similar to the outside wall portion as long as the area of the back wall portion does not fall below the area of the central leg portion.

In one embodiment of the invention (see FIG. 8), the end segments 86, 87 are not arcuate but are essentially straight with respect to the parts of the outside wall portion above the third axis. The lowermost parts of the end segments of the outside wall portions are not included in the area calculations since the lowermost parts do not present a uniform flux path length.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A core for use in a component including a coiled conductor, the core comprising:

a back wall portion having a front and a back, the back wall portion having a lower end and an upper end and a pair of sides extending between the lower and upper ends;

a central leg portion protruding from the front of the back wall portion, the central leg portion extending from the front of the back wall portion; and an outside wall portion protruding from the front of the back wall portion;

wherein the central leg portion is elongated along a first axis extending between the upper and lower ends of the back wall portion.

2. The core of claim 1 wherein the central leg portion has an intermediate section and a pair of end sections, the intermediate section being located between the end sections, the intermediate section and end sections being located along the first axis, the intermediate section having a length extending parallel to the first axis.

3. The core of claim 2 wherein the intermediate section has a width extending perpendicular to the first axis, the width of the intermediate section being substantially uniform along the length of the intermediate section.

4. The core of claim 3 wherein the intermediate section has a substantially rectangular shape in a plane oriented substantially parallel to the front of the back wall portion.

5. The core of claim 2 wherein an outer surface of the central leg portion has a pair of substantially planar extents, the substantially planar extents being located on the intermediate section of the central leg portion, the substantially planar extents being substantially parallel and being substantially parallel to the first axis.

6. The core of claim 5 wherein each of the end sections is semi-cylindrical with a center of curvature and a radius, an outer surface of the end sections of the central leg portion each having a curved extent, the arcuate extents being located on the end sections of the central leg section.

7. The core of claim 1 wherein the central leg portion is spaced from the lower edge of the back wall portion.

8. The core of claim 7 wherein a channel is formed between the central leg portion and the outside wall portion for receiving a portion of a coiled conductor, and the channel extends between the central leg portion and the lower edge of the back wall portion at a location along the first axis.

9. The core of claim 8 wherein a second axis and a third axis extend substantially perpendicular to the first axis, the second axis extending along a border between a primary one of the end sections of the central leg portion and the intermediate portion of the central leg portion, the third axis extending along a border between a secondary one of the end sections of the central leg portion and the intermediate portion, the extended portion of the channel being located between the third axis and the lower edge of the back wall portion.

10. The core of claim 9 wherein the outside wall portion has a pair of ends located adjacent the lower end of the back wall portion, a separation gap being formed between the ends of the outside wall portion, an end segment being located adjacent to each of the ends, the end segment of the outside wall portion extending between the third axis and the end of the outside leg portion, the end segment extending along an arc, the arc defining a closure angle being centered on the center of curvature of the secondary end section of the central leg portion.

11. The core of claim 10 wherein the closure angle of a first one of the end segments is substantially equal to the closure angle of a second one of the end segments.

12. The core of claim 10 wherein the central leg portion has an outer surface and the outside leg portion has an inner surface facing the outer surface of the central leg portion, wherein a channel is formed between an outer surface of the central leg portion and an inner surface of the outside wall portion, the channel having a width measured between the outer surface of the central leg portion and the inner surface of the outside wall portion, the portions of the channel extending adjacent to the arc of the end segments of the outside wall portion having a width substantially equal to a width of the channel extending between the intersections of the third axis with the channel.

13. The core of claim 1 wherein the central leg portion has an area, the outside wall portion has an area, and the back wall portion has an area, and wherein the areas of the outside wall portion and the back wall portion are each at least approximately equal to the area of the central wall portion.

14. A core assembly for use in a component, the core assembly comprising:

a pair of cores, each of the cores comprising:

a back wall portion having a front and a back, the back wall portion having a lower end and an upper end and a pair of sides extending between the lower and upper ends;

a central leg portion protruding from the front of the back wall portion, the central leg portion extending from the front of the back wall portion; and an outside wall portion protruding from the front of the back wall portion;

wherein the central leg portion is elongated along a first axis extending between the upper and lower ends of the back wall portion.

15. The core assembly of claim 14 wherein the pair of cores have a footprint area, the central leg portion has an area, and a ratio of the area of the central leg portion to the footprint area is greater than approximately 0.14.

16. The core assembly of claim 14 wherein the pair of cores have a footprint area, the central leg portion has an area, each of the cores has an effective length, and a ratio of the area of the central leg portion to a product of the footprint area and the effective length is at least approximately 0.8 5%.

17. The core assembly of claim 14 wherein the pair of cores has a footprint area, the central leg portion has a perimeter, and a ratio of the perimeter of the central leg portion to the footprint area is at least approximately 0.16/mm.

18. A core for use in a component including a coiled conductor, the core comprising:

a back wall portion having a front and a back, the back wall portion having a lower end and an upper end and a pair of sides extending between the lower and upper ends;

a central leg portion protruding from the front of the back wall portion, the central leg portion extending from the front of the back wall portion; and an outside wall portion protruding from the front of the back wall portion;

wherein the central leg portion is spaced from the lower edge of the back wall portion.

19. The core of claim 18 wherein a channel is formed between the central leg portion and the outside wall portion for receiving a portion of a coiled conductor, and the channel extends between the central leg portion and the lower edge of the back wall portion at a location along the first axis.

20. The core of claim 19 wherein a second axis and a third axis extend substantially perpendicular to the first axis, the second axis extending along a border between a primary one of the end sections of the central leg portion and the intermediate portion of the central leg portion, the third axis extending along a border between a secondary one of the end sections of the central leg portion and the intermediate portion, the extended portion of the channel being located between the third axis and the lower edge of the back wall portion.

21. The core of claim 20 wherein the outside wall portion has a pair of ends located adjacent the lower end of the back wall portion, a separation gap being formed between the ends of the outside wall portion, an end segment being located adjacent to each of the ends, the end segment of the outside wall portion extending between the third axis and the end of the outside leg portion, the end segment extending along an arc, the arc defining a closure angle being centered on the center of curvature of the secondary end section of the central leg portion.

22. The core of claim 21 wherein the closure angle of a first one of the end segments is substantially equal to the closure angle of a second one of the end segments.

23. The core of claim 22 wherein the central leg portion has an outer surface and the outside leg portion has an inner surface facing the outer surface of the central leg portion, wherein a channel is formed between an outer surface of the central leg portion and an inner surface of the outside wall portion, the channel having a width measured between the outer surface of the central leg portion and the inner surface of the outside wall portion, the portions of the channel extending adjacent to the arc of the end segments of the outside wall portion having a width substantially equal to a width of the channel extending between the intersections of the third axis with the channel.

24. A component comprising:

a coil assembly, the coil assembly comprising:

a bobbin, the bobbin comprising:

a central tubular portion having opposite ends, the central tubular portion having a lumen extending between the ends, the lumen having an oblong cross section taken perpendicular to an axis of the lumen between the ends; and a pair of end flanges, each end flange being mounted on one of the ends of the central tubular portion, each of the end flanges having a perimeter, the perimeter having an oblong shape;

a coiled conductor mounted on the bobbin, the coiled conductor being wound about the central tubular portion of the bobbin;

a base structure for mounting the bobbin on a circuit board, the base structure comprising a base foot mounted on one of the end flanges of the bobbin, each of the base feet having a plurality of conductive leads extending therefrom;

a ferrite core assembly for mounting on the coil assembly, the ferrite coil assembly being adapted to substantially enclose the coil assembly, the ferrite core assembly comprising a pair of cores, the cores being adapted for positioning in an opposed, mirrored relationship about the bobbin and the coiled conductor, each of the cores comprising:

a back wall portion having a front and a back, the back wall portion having an outer perimeter, the back wall portion having a thickness defined between the front and back, the thickness of the back wall portion being substantially uniform, the back wall having a substantially rectangular perimeter, the back wall portion having a lower end and an upper end and a pair of sides extending between the lower and upper ends, the back of the back wall portion being substantially planar;

a central leg portion protruding from the front of the back wall portion, the central leg portion extending from the front of the back wall portion, the central leg portion having an outer surface extending substantially perpendicular to the front of the back wall portion, the central leg portion being elongated along a first axis extending substantially perpendicular to the lower end of the back wall portion, the central leg portion having an intermediate section and a pair of end sections, the intermediate section being located between the end sections, the intermediate section having a length extending parallel to the first axis and a width extending perpendicular to the first axis, the width of the intermediate section being substantially uniform along the length of the intermediate section, the intermediate section having a substantially rectangular shape in a plane oriented substantially parallel to the front of the back wall portion, the outer surface of the central leg portion having a pair of substantially planar extents, the substantially planar extents being located on the intermediate section of the central leg portion, the substantially planar extents being substantially parallel to each other;

each of the end sections being semi-cylindrical with a center of curvature and a radius, the outer surface of the central leg portion having a pair of curved extents, the arcuate extents being located on the end sections of the central leg section, the central leg portion having a forward face, the forward face of the central leg portion being substantially planar and lying in a plane substantially parallel to the front of the back wall portion;

a second and a third axis extending substantially perpendicular to the first axis, the second axis extending along a border between a primary one of the end sections of the central leg portion and the intermediate portion of the central leg portion, the third axis extending along a border between a secondary one of the end sections of the central leg portion and the intermediate portion;

the central leg portion having an area equal to an area of the forward face of the central leg portion, the area of the central leg portion being equal to the radius of the end sections multiplied by pi plus the product of the width of the intermediate section times the length of the intermediate section;

an outside wall portion protruding from the front of the back wall portion, the outside wall portion having a substantially horseshoe arch configuration, the outside wall having an inner surface, the inner surface having an arcuate extent in an opposed relationship to one of the curved extent of the outer surface of the central leg portion, the outside wall portion having an outside surface, the outside wall portion having a width measured between the inkier surface of the outside wall portion and the outside surface of the outside wall portion along a line extending perpendicular to a tangent to the inner surface of the outside wall portion, the outside wall portion having a pair of ends located adjacent the lower end of the back wall portion, a separation gap being formed between the ends of the outside wall portion, the separation gap being bisected by the first axis, an end segment being located adjacent to each of the ends, the end segment of the outside wall portion extending between the third axis and the end of the outside leg portion, the end segment extending along an arc, the arc defining a closure angle centered on the center of curvature of the secondary end section of the central leg portion and measured between the third axis and the end of the outside wall portion, the closure angle of a first one of the end segments being substantially equal to the closure angle of a second one of the end segments, the outside wall portion having a forward face being substantially planar and lying in a plane substantially parallel to the front of the back wall portion, the outside wall portion having a thickness measured between the forward face of the outside wall portion and the front of the back wall portion, the thickness off the outside wall portion being substantially uniform;

a plurality of flux path axes extending outwardly from the central leg portion, each flux path axis extending perpendicular to a tangent to a location on the outer surface of the central leg portion;

wherein a gap is formed between the outer surface of the central leg portion and the inner surface of the outside wall portion, the gap forming a channel about the central leg portion, the gap having a width measured between the outer surface of the central leg portion and the inner surface of the outside wall portion along each flux path axis, the gap having a depth measured between the front of the back wall portion and a plane defined by the forward face of the outside wall portion;

wherein the secondary end portion is spaced from the bottom edge of the back wall portion of the core for extending the channel between the central leg portion and the bottom edge of the back wall portion, an extended portion of the channel located between the third axis and bottom edge of the back wall portion having a uniform width, the inner surface of the outside wall portion along the extended portion of the channel extending along substantially the entirety of the closure angle.

25. The core of claim 1 wherein the back wall has an arcuate top edge.

26. the core of claim 25, wherein the outside wall portion has a similar profile to the back wall.

27. The core of claim 1, wherein the back wall has rounded corners towards the upper end of the back wall.

28. The core of claim 9, wherein the outside wall portion has a pair of ends located adjacent the lower end of the back wall portion, a separation gap being formed between the ends of the outside wall portion, and end segment being located adjacent to each of the ends, the end segments of the outside wall portion extending between the third axis and the end of the outside leg portion, the end segment extending essentially straight with respect to the parts of the outside wall portion above the third axis.

* * * * *